United States Patent [19]

Kudo

[11] Patent Number: 4,808,020

[45] Date of Patent: Feb. 28, 1989

[54] CARRIAGE FIXING MECHANISM FOR PRINTING APPARATUS

[75] Inventor: Satoshi Kudo, Tokyo, Japan

[73] Assignee: Kabushiki Kaisha Toshiba, Kawasaki, Japan

[21] Appl. No.: 17,042

[22] Filed: Feb. 20, 1987

[30] Foreign Application Priority Data

Feb. 26, 1986 [JP] Japan ..... 61-25721[U]

[51] Int. Cl.[4] ..... B41J 29/54

[52] U.S. Cl. ..... 400/663; 400/674

[58] Field of Search ..... 400/663, 674; 403/289; 24/458, 336

[56] References Cited

U.S. PATENT DOCUMENTS 2,963,546 12/1960 Hodne ..... 400/663 X 4,452,542 6/1984 Akazawa ..... 400/175

FOREIGN PATENT DOCUMENTS 3235339 3/1984 Fed. Rep. of Germany .

351618 3/1961 Switzerland .

OTHER PUBLICATIONS

"Carriage Lock", IBM Technical Disclosure Bulletin, vol. 28, No. 7, Dec. 1985, p. 2889.

Wilmoth, T. L., "Carriage-Locking Mechanism", IBM Technical Disclosure Bulletin, vol. 22, No. 12, May 1980, p. 5229.

*Primary Examiner*—Edgar S. Burr

*Assistant Examiner*—James Lisehora

*Attorney, Agent, or Firm*—Finnegan, Henderson, Farabow, Garrett, & Dunner

[57] ABSTRACT

In a carriage fixing mechanism for a printing apparatus, engaging openings are formed in a frame disposed at a side portion of the printer and a side portion of a carriage, respectively. The mechanism includes a fixing member. The fixing member includes a first engaging portion to be detachably engaged with the opening of the frame and a second engaging portion to be detachably engaged with the opening of the carriage.

3 Claims, 4 Drawing Sheets

CARRIAGE FIXING MECHANISM FOR PRINTING APPARATUS

BACKGROUND OF THE INVENTION

1. Field of the Invention

The present invention relates to a mechanism for fixing a carriage of a printing apparatus. More particularly, the present invention relates to a mechanism for fixing a carriage so as to prevent damage to the carriage upon itsmovement by an impact during the transportation of a printing apparatus having plate-like side frames disposed at both sides of the printer apparatus, a guide rail extending between the side frames, and the carriage supporting a print head and adapted to be reciprocally guided along the guide rail.

2. Description of the Prior Art

In a conventional printing apparatus, a platen is disposed to be parallel to a guide rail, and a carriage is reciprocally guided along the guide rail. A printing head is mounted on the carriage. At the time of printing, the carriage is reciprocally driven by a drive mechanism, and the printing head on the carriage prints information on paper guided by the platen.

During the transportation of the printing apparatus, the carriage is moved along the guide rail upon application of external vibrations and impacts, and the carriage strikes against a frame or the like of the printing apparatus. In this case, the carriage, the printing head mounted thereon, and the like are often damaged.

In order to prevent the printer components from being damaged, the carriage is moved to the right or left end at the time of shipment of the printing apparatus from a factory. The carriage is fixed to the frame of the printing apparatus through a band or the like, thereby preventing the frame and the like from being damaged. The band is exemplified by a conventional bundle fastener used for packaging the wires.

However, the carriage must be manually fixed to the frame through the bundle fastener, and such manual operation is burdensome. Packing efficiency for printing apparatuses in the production line is degraded. When the carriage is to be released from the frame, the bundle fastener must be cut off and cannot be used again. When a printing apparatus installed in an office or the like is required to be relocated, the carriage must be fixed again by another bundle fastener. However, such a bundle fastener is not often available in an office or the like. The printing apparatus is then transported while the carriage is not fixed to the frame, thereby causing damage to the carriage and the like.

A mechanism is proposed to eliminate the above disadvantage. In this mechanism, a printer component is utilized to easily fix the carriage, which does not require a separate carriage fixing member. An example of such a mechanism is described in Japanese Utility Model Application No. 60-184974 filed by the present assignee on Nov. 29, 1985. The same application was also applied to the United States of America on Nov. 26, 1986, claiming priority and has Ser. No. 934,960.

In the above prior patent application, a hook extends from a lever disposed at an end of a guide rail for guiding a carriage so as to adjust a distance between the guide rail and a platen and hence a distance between a printing head and the platen. When the lever is pivoted by an angle exceeding the normal pivotal angle adjustment range, the hook is engaged with the side portion of the carriage to fix the carriage. In this mechanism, the carriage can be fixed without using a separate fixing member. Carriage fixing operation at the time of shipment in a factory can be simplified. In addition, once the printing apparatus installed in an office is required to be transported to another location, the carriage can be easily fixed. However, this prior invention can be applied to only printing apparatuses with a proper member such as a lever.

SUMMARY OF THE INVENTION

It is a first object of the present invention to provide a carriage fixing mechanism capable of easily fixing a carriage in a printing apparatus.

It is a second object of the present invention to provide a carriage fixing mechanism capable of fixing a carriage without utilizing a specific component in a printing apparatus and of being applied to printing apparatuses of any type.

In order to achieve the above objects of the present invention, there is provided a carriage fixing mechanism in a printing apparatus having plate-like side frames disposed at both sides of the printing apparatus and a carriage guided by a guide rail, wherein an engaging opening is formed in the frame, an engaging opening is formed at a side portion of the carriage, a separate fixing member independent of the frame and the carriage is prepared, and the fixing member comprises a first engaging portion for detachably engaging with the engaging opening of the frame and a.second engaging portion for detachably engaging with the engaging opening of the carriage.

According to an embodiment of the present invention, the fixing member is integrally made of a synthetic resin material. The fixing member comprises a plate and first and second arms formed integrally with both sides of the plate. Hooks are formed at the distal ends of the first and second arms, respectively. The first arm can be engaged with the opening of the frame, and the second arm can be engaged with the opening of the carriage. The upper end of the plate and the upper end of a first arm extend upward. When these extended upper end portions are pinched, the distal end of the first arm is separated from the plate. In the case of engaging the fixing member with the engaging openings, attachment-/detachment of the member can be smoothly performed. In the case of transportation of the printing apparatus, the first arm is engaged with the opening of the frame, and the second arm is engaged with the opening of the carriage, thereby fixing the carriage. At the time of use of the printer, the second arm is disengaged from the opening of the carriage, while the first arm is kept engaged with the opening of the frame so as to cause the frame to support the fixing member and hence prevent the fixing member from being lost.

BRIEF DESCRIPTION OF THE DRAWINGS

The present invention will be fully understood with reference to the following detailed description of preferred embodiments in conjunction with the accompanying drawings, in which.

DETAILED DESCRIPTION OF THE PREFERRED EMBODIMENTS

Figure 1:
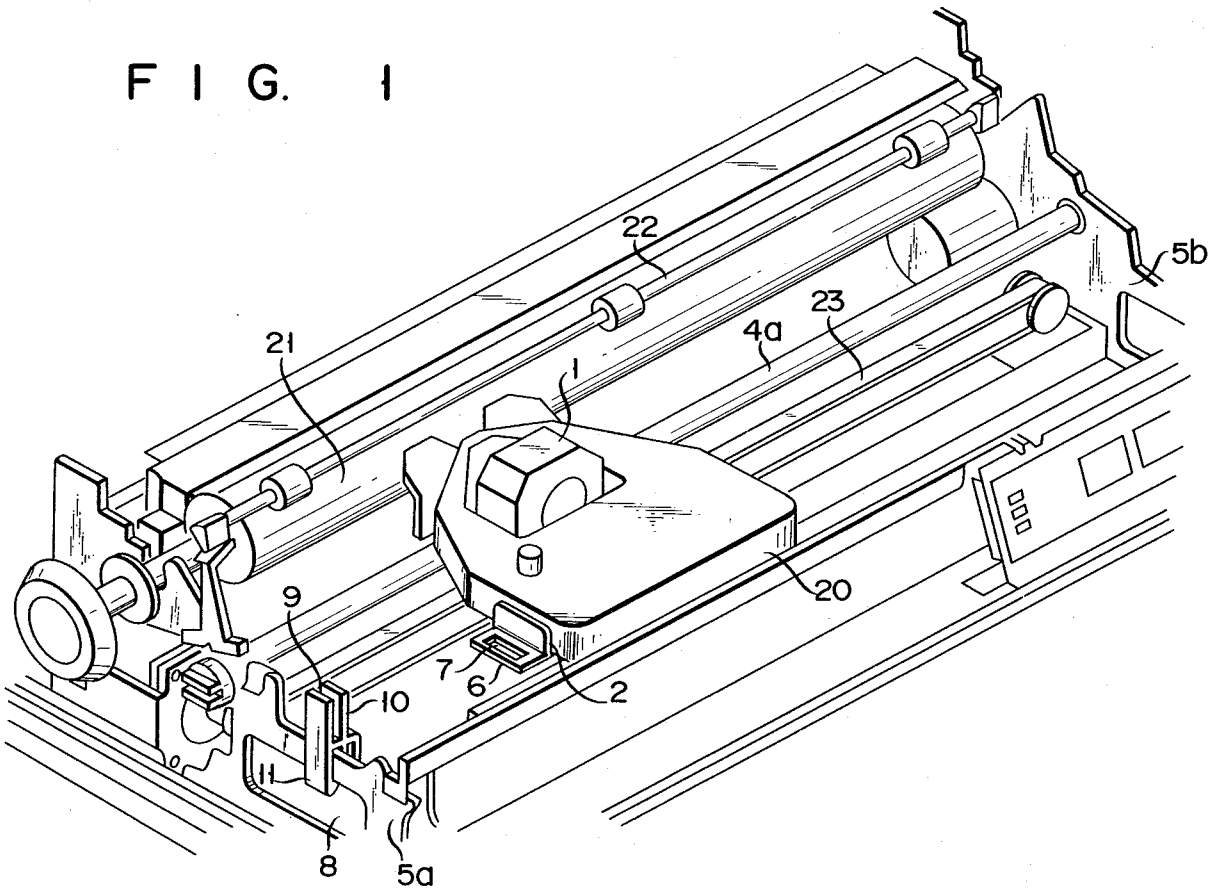
FIG. 1 is a perspective view of a printing apparatus having a carriage fixing mechanism according to an embodiment of the present invention.

Preferred embodiments of the present invention will be described with reference to the accompanying drawings. FIG. 1 shows a printer apparatus having a carriage fixing mechanism according to an embodiment of the present invention. The printing apparatus comprises platen 21 and plate-like side frames 5*a* and 5*b*. Platen 21 is parallel to guide rail 4*a*. Carriage 2 is reciprocally guided along rail 4*a*. Carriage 2 is designed to move through belt 23 of the drive mechanism in the right-and-left direction. Printing head 1 and ink ribbon cartridge 20 are mounted on carriage 2. Reference numeral 22 denotes a paper bail bar.

Engaging opening 8 is formed in side frame 5*a*. Plate-like fixing projection 6 extends from the side portion of carriage 2. Engaging opening 7 is formed in projection 6.

Figure 2:
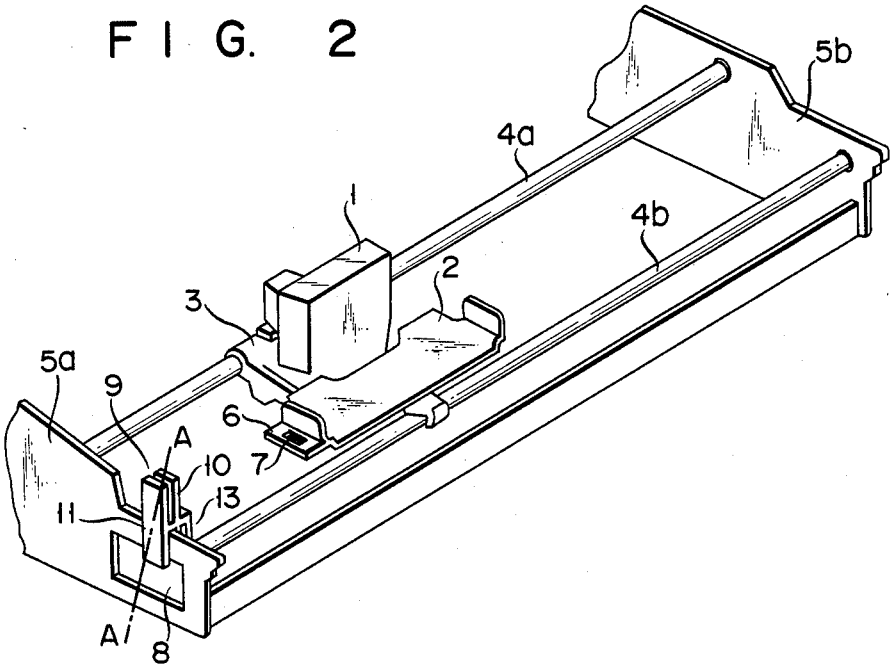
FIG. 2 is a perspective view showing only the main part of the printing apparatus shown in FIG. 1.
Figure 3:
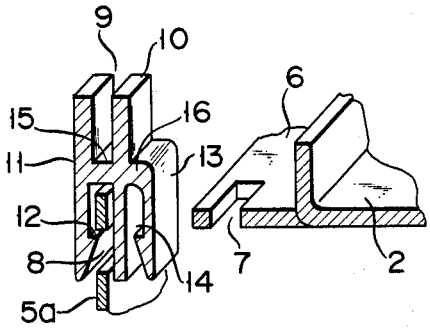
FIG. 3 is a perspective view showing a partial section of a carriage fixing mechanism of FIG. 2 taken along the line A—A thereof.

Fixing member 9 is arranged to fix carriage 2 to side frame 5*a*. The fixing member is arranged, as shown in FIGS. 1 to 3. Member 9 is integrally made of a synthetic resin material or the like and comprises plate 10, first arm 11 formed at one side of wall 10 and substantially parallel thereto, and second arm 13 formed at the other side of plate 10 and substantially parallel to plate 10. Arms 11 and 13 are connected to substantially the center of plate 10 through connecting portions 15 and 16. Hooks 12 and 14 extend from the distal ends of arms 11 and 13, respectively. The upper ends of first arm 11 and plate 10 extend upward. The upper edge portion of side frame 5*a* is clamped between first arm 11 and plate 10 of fixing member 9. Hook 12 at the distal end of arm 11 is engaged with the engaging opening to prevent the fixing member from being removed from side frame 5*a*. Therefore, member 9 is not lost.

Figure 4:
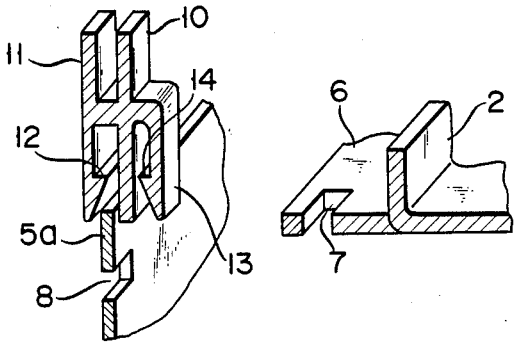
FIGS. 4 to 6 are views corresponding to the view in FIG. 3.
Figure 5:
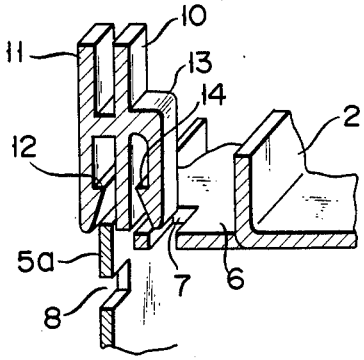
Figure 6:
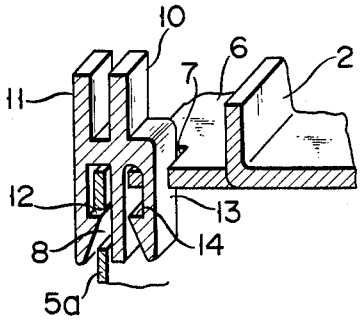

When this printing apparatus is shipped from a factory or when it is transported to another location after it is installed in an office or the like, carriage 2 is fixed by fixing member 9 so as to prevent carriage 2 from being moved. In order to fix carriage 2 to side frame 5*a*, fixing member 9 is removed from side frame 5*a*, as shown in FIG. 4. In this case, the upper end portions of plate 10 and first arm 11 are pinched, the distal end of arm 11 is separated from plate 10, so that hook 12 at the distal end of arm 11 is disengaged from the edge of engaging opening 8. Fixing member 9 can be smoothly removed from side wall 5*a*. Subsequently, as shown in FIG. 5, carriage 2 is moved toward side frame 5*a*. Fixing member 9 is moved downward so as to clamp the upper edge portion of frame 5*a* between plate 10 and arm 11 of fixing member 9. As shown in FIG. 6, hook 12 at the distal end of arm 11 is engaged with the edge of engaging opening 8, and arm 13 is inserted in engaging opening 7 formed in projection 6 extending from carriage 2. Therefore, carriage 2 can be fixed to side frame 5*a* through fixing member 9. Since hooks 12 and 14 are formed at the distal ends of arms 11 and 13, they are hooked at the edges of engaging openings 8 and 7, respectively, thereby preventing removal of member 9 even if vibrations or the like act thereon.

During use of the printer, fixing member 9 is held at the upper edge portion of side frame 5*a*, as shown in FIGS. 1 to 3. If the drive mechanism for carriage 2 is broken and carriage 2 overruns, carriage 2 strikes against arm 13 of fixing member 9. However, elasticity of arm 13 buffers the collision impact, and hence damage to carriage 2 and the like can be prevented.

When the printing apparatus is used, the carriage fixing mechanism is held at the upper edge portion of side frame 5*a*, and member 9 is not lost. In the case of fixing carriage 2, it can be fixed by simple operations described above. Further, since any component of the printing apparatus is not used for fixing the carriage, the carriage fixing mechanism according to this embodiment can be applied to all types of printers.

Hook 14 clickes every time second arm 13 is inserted into opening 7 of carriage 2, or is pulled out of opening 7. Nonetheless, hook 14 can be dispensed with.

Figure 7:
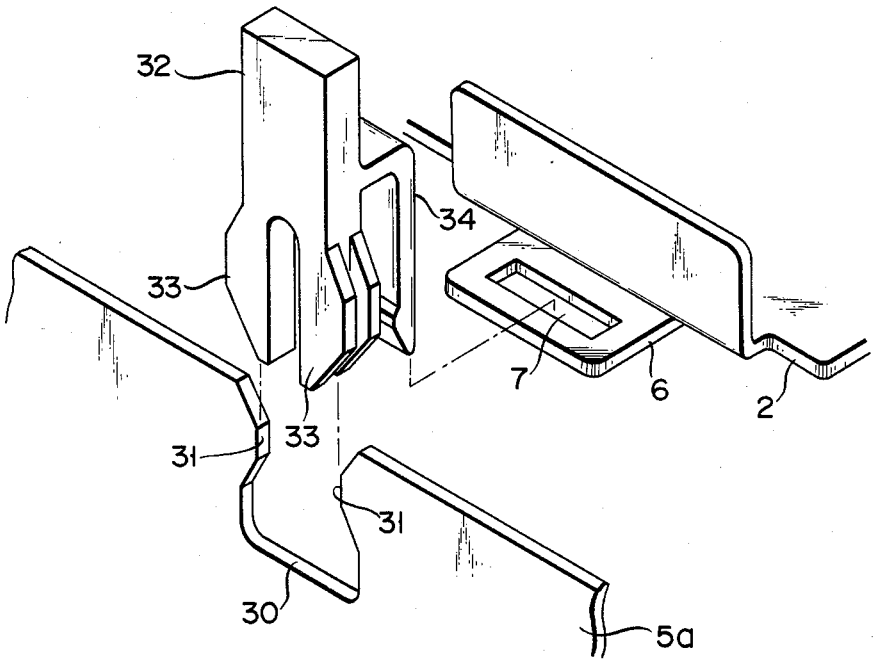
FIG. 7 is a perspective view of a carriage fixing mechanism according to another embodiment of the present invention.

FIG. 7 shows a second embodiment of the present invention. In this embodiment, engaging notch 30 is formed at the upper edge portion of side frame 5*a*. Notch 30 is narrowed by projections 31. A pair of deformable legs 33 are formed at the lower end portion of fixing member 32. Arm 34 is formed in member 32 in the same manner as in the above embodiment.

In this embodiment, when fixing member 32 is pushed into engaging recess 30, legs 33 are deformed by projections 31, and member 32 is held at the upper edge portion of frame 5*a* by an elastic force of legs 33. Arm 34 is inserted in engaging opening 7 of carriage 2 to fix carriage 2 to side frame 5*a*.

The present invention is not limited to the particular embodiments described above. Various changes and modifications may be made within the spirit and scope of the invention.

What is claimed is:

1. A carriage fixing member for a printing apparatus having a platen, side frames, and a carriage moveable between the side frames and parallel to the platen, the carriage having an engaging opening, the carriage fixing member comprising:

a flat plate;

a first engaging portion engageable with an edge of one of said side frames, said first engaging portion including a first arm portion formed at one side of said flat plate and substantially parallel to and separated from said flat plate, said edge of one of said side frames being insertable between said flat plate and said first arm portion; and a second engaging portion engageable with said engaging opening, said second engaging portion including a second arm portion formed at the other side of said flat plate and substantially parallel to an separated from said flat plate, said second arm portion being insertable through said engaging opening.

2. A carriage fixing member for a printing apparatus having a platen, side frames, and a carriage moveable between the side frames parallel to the platen, said carriage having an engaging opening, and carriage fixing member comprising:

a first engaging portion engageable with an edge of one of said side frames;

a second engaging portion engageable with said engaging opening; and a flat plate having a first side and a second side, said first engaging portion including a first arm fixed at one end to said flat plate and extending substantially parallel to and spaced from said first side of said flat plate, said second engaging portion including a second arm fixed at one end to said flat plate and extending substantially parallel to and spaced apart from said second side of said flat plate.

3. A carriage fixing member for a printing apparatus having a platen, side frames, and a carriage moveable between the side frames parallel to the platen, said carriage having an engaging opening, said carriage fixing member comprising:

a first engaging portion engageable with an edge of one of said side frames, said edge of one of said side frames having a notch engageable with said first engaging portion;

a second engaging portion engageable with said engaging opening; and a flat plate having a first side and a second side, said first engaging portion including one or more deformable legs extending from said flat plate for removably engaging said notch in said side frame, said second engaging portion including an arm portion fixed at one end to said flat plate and extending substantially parallel to and spaced from said first side of said flat plate.

* * * * *